United States Patent [19]

Saveliev et al.

[11] 4,285,192

[45] Aug. 25, 1981

[54] TWISTING MEMBER FOR RINGLESS SPINNING APPARATUS

[76] Inventors: Alexandr I. Saveliev, ulitsa Dybenko, 34, kv. 71; Elizaveta A. Brezulova, 2 Donskoi proezd, 6, kv. 36, both of Moscow, U.S.S.R.

[21] Appl. No.: 80,447

[22] Filed: Oct. 1, 1979

[51] Int. Cl.[3] ..... D01H 7/882

[52] U.S. Cl. ..... 57/58.89

[58] Field of Search ..... 57/58.89–58.95

[56] References Cited

U.S. PATENT DOCUMENTS 3,877,211 4/1975 Saveliev et al. ..... 57/58.89

FOREIGN PATENT DOCUMENTS 225049 8/1968 U.S.S.R. ..... 57/58.95

*Primary Examiner*—John Petrakes

*Attorney, Agent, or Firm*—Steinberg & Raskin

[57] ABSTRACT

The invention relates to twisting members for use in connection with rotary twisting machines. The twisting member comprises a rotor coupled to a disc having a duct formed therethrough. The outlet of the duct is arranged eccentrically with respect to the axis of rotation of the rotor. The rotor further includes a sleeve, with a ball accommodated between the rotor and the sleeve to define with the latter a means for resiliently clamping the thread being formed.

5 Claims, 5 Drawing Figures

TWISTING MEMBER FOR RINGLESS SPINNING APPARATUS

FIELD OF INVENTION

The present invention relates to apparatus for ringless spinning of textile fibres, wherein the spinning process is separated from the process of winding the yarn, and, more particularly, it relates to a twisting member for use in connection with such apparatus.

The present invention can be used most efficiently in rotary spinning machines intended for production of yarn of high linear densities (as high as 220 to 84 tex) from low-grade cotton, cotton-spinning waste, short woolen fibres, chemical fibres up to 70 mm long, and various blends of the types of fibres listed above.

BACKGROUND OF INVENTION

In the fibre-spinning production of the present-day textile industry the most promising trend is the employment of ringless spinning apparatus. Such apparatus can be generally categorized into two classes, the first class including apparatus wherein the working member is in the form of a rotary spinning chamber, while the second class includes apparatus where a twisting member in the form of a rotatable rotor acts as the work-performing member.

At present, there are commonly known ringless spinning arrangements wherein the spinning member includes a rotatable rotor (cf. U.S. Pat. No. 3,877,211; Cl. 57/58.89; dated April, 1975). The rotor includes a disc having a central duct formed therethrough for the passage of fibres and a sleeve arranged axially of the rotatable rotor, underlying the disc and being resiliently urged thereto. The disc has a supporting surface adapted to receive fibres thereon and to shape them into a thread, with the rotor rotating. Fibres are retained on the surface of the disc owing to the mechanical action thereupon of projections provided on the surface of the disc.

However, since there is no elastic clamping action exerted on the thread being formed, the device of the prior art displays a tendency of producing loose yarn with low physical and mechanical properties. Such yarn is practically unfit for further utilization.

The above drawback can be eliminated by employing a twisting member of the kind disclosed in the SU Inventor's Certificate No. 225,049; Int. Cl. D 01 H, published on Aug. 12, 1968 which we consider the closest prototype of the present invention. This twisting member comprises a rotor including a disc with a central through-going duct for the passage of fibres, a sleeve arranged axially of the disc, underlying the latter and being resiliently urged toward the disc. Interposed between the disc and the sleeve is a spherical element, or ball defining with the sleeve a means for resiliently clamping the thread being formed.

However, twisting members of the above type have proved to show a high thread breakage rate. This can be explained by the fact that the resilient clamping action exerted by the ball takes place in two zones of which the first one is between the disc and the ball, and the second one is between the ball and the sleeve.

The first zone of clamping is one occupied by separate fibres with little or no interconnection therebetween, whereas in the second zone the fibres are already twisted into a thread and exhibit considerable adhesion to one another.

When either large particles of foreign matter or strands of fibres become situated in the first clamping zone, the fibres are held fast, and, consequently, their access to the second clamping zone is halted, whereby the fibres that are already in the second zone are being torn apart under the action of the forces of tension, while there is no in-feed of fibres from the first clamping zone.

BRIEF DESCRIPTION OF INVENTION

It is an object of the present invention to create a twisting member for use in ringless spinning apparatus, wherein the improved construction of the disc should provide for reduction of the thread breakage rate.

It is an important object of the present invention to prevent fibres from being torn apart while the thread is being formed.

These and other objects are attained in a twisting member comprising a rotor including a disc with a duct formed there-through for the passage of fibres, a sleeve arranged axially of the axis of rotation of the disc, underlying the disc and being resiliently urged thereto, and a ball accommodated between the disc and the sleeve and defining with the latter a means for resiliently clamping the thread being formed, in which twisting member, in accordance with the invention, the outlet of the duct of the disc is arranged eccentrically with respect to the axis of rotation of the rotor.

The eccentric arrangement of the outlet of the duct of the disc, in fact, eliminates the aforementioned first clamping zone, i.e. the clamping zone between the disc and the ball, which enables fibres to enter the second clamping zone in an unobstructed fashion.

On the other hand, should foreign matter and strands of fibres become situated in the second clamping zone, this would not result in a tearing apart or braking action, because in this area the fibres have been already twisted into a thread, and the strength of their engagement is substantially higher than the tension under which the thread is pulled out from the clamping area. Therefore, breakage of the thread has been practically precluded.

To prevent unwanted displacement of the ball, which might be caused by the action thereupon of strands of fibres or thickened portions of the thread becoming situated in the zone of clamping between the ball and the sleeve, it is expedient that the disc should be provided on the side thereof facing the ball, with means for limiting displacement of the ball relative to the axis of the rotor, such as a notch axially aligned with the rotor.

BRIEF DESCRIPTION OF DRAWINGS

The present invention will be better understood from the following description of embodiments thereof, with reference being made to the accompanying drawings, wherein.

DETAILED DESCRIPTION OF THE PREFERRED EMBODIMENTS

Figure 1:
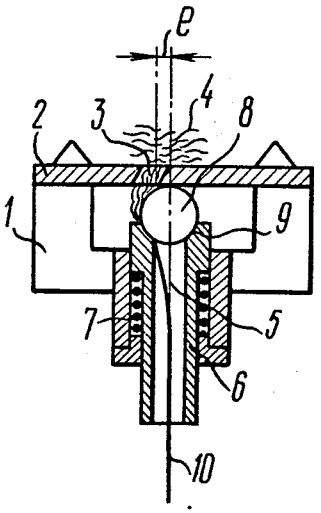
FIG. 1 is a general sectional view of a twisting member embodying the invention.

Referring now in particular to the appended drawings, the disclosed twisting member comprises a rotor 1 (FIG. 1) including a disc 2 having a duct 3 and through which fibres 4 are adapted to pass, the disc 2 being rotatable by any suitable known driving means. Extending along the axis 5 of rotation of the rotor 1 and underlying the disc 2 is a sleeve 6 resiliently urged by a spring 7 toward the disc 2. The rotor 1 is connectable through a spindle (not shown) to a drive means (not shown) capable of rotating it during operation. Interposed between the disc 2 and the sleeve 6 is a ball 8 defining with the sleeve 6 a resilient clamping means 9 for the thread 10 being formed.

The outlet of the duct 3 in the disc 2 is arranged eccentrically with respect to the axis 5 of rotation of the rotor 1, as can be seen in FIG. 1, with an eccentricity "e".

Figure 2:
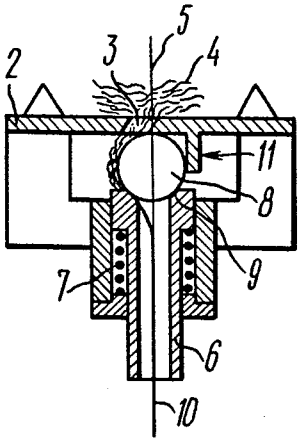
FIG. 2 is a view similar to FIG. 1, and illustrating means for limiting displacement of the ball.
Figure 3B:
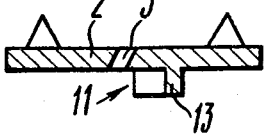
FIG. 3*a*, FIG. 3*b* and FIG. 3*c* show modifications of the means for limiting displacement of the ball, illustrated in FIG. 2.
Figure 3A:
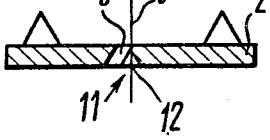

To prevent displacement of the ball 8 relative to the axis 5 of the rotor 1, should thick matter or strands of fibres get into the clamping means 9, the disc 2 (FIG. 2) is provided, on the side thereof, which faces the ball 8, with means 11 for limiting displacement of the ball 8 relative to the axis 5 of the rotor 1. In one embodiment, the means 11 is in the form of a notch 12 (FIG. 3*a*) formed in the disc 2 in axial alignment with the rotor 1.

Figure 3C:
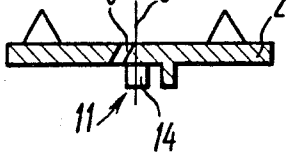

However, the displacement limiting-means 11 may also be in the form of an annular lug 13 (FIG. 3*b*) partly open adjacent to the outlet of the duct 3 and arranged coaxially with the rotor 1. Alternatively, the displacement limiting means may take the form of a series of spaced projections 14 (FIG. 3*c*) arranged concentrically with respect to the axis 5 of rotation of the rotor 1.

The disclosed twisting member operates, as follows.

With the twisting member rotating in operation, fibres 4 fed onto the disc 2 in any suitable known manner are drawn by cohesion forces into the duct 3 through which they pass in an unobstructed manner, and are twisted into the thread 10 upon having passed through the resilient clamping means, or nip 9.

Should either large particles of foreign matter or thickened portions of the thread being formed become situated in the resilient clamping means 9, they would tend to displace the ball 8 away from the axis 5 of rotation of the rotor 1. However, the means 11 would prevent excessive displacement of the ball 8, whereby the process of forming the thread 10 would be unaffected.

What is claimed is:

1. In a twisting member for use in connection with a ringless spinning apparatus, comprising:

a rotor adapted to be rotated about an axis of rotation;

a disc mounted on said rotor and having a duct formed therethrough through which fibres are adapted to pass exiting from an outlet thereof; a sleeve arranged coaxially along the axis of rotation of said rotor underlying a surface of said disc onto which the outlet of the duct opens, said sleeve being resiliently urged towards the disc surface; a ball accommodated between said disc and an end of said sleeve, said ball defining with said sleeve a means for resiliently clamping the thread being formed therebetween, the improvement comprising: that the outlet of the duct of said disc is arranged eccentrically with respect to the axis of rotation of said rotor such that the outlet of the duct is laterally displaced from the region of the ball whereby no clamping action can be effected on the fibres between the disc and the ball.

2. A twisting member as claimed in claim 1, wherein said disc is provided on the surface thereof facing said ball with a means for limiting displacement of said ball relative to the axis of rotation of said rotor.

3. A twisting member as claimed in claim 2, wherein the displacement-limiting means includes a notch aligned with the axis of rotation of said rotor.

4. A twisting member as claimed in claim 2, wherein the displacement-limiting means includes an annular lug partly open adjacent to the outlet of said disc and arranged coaxially with said rotor.

5. A twisting member as claimed in claim 2, wherein said displacement-limiting means includes a series of spaced projections arranged concentrically with the axis of rotation of said rotor.

* * * * *